United States Patent [19]

Okada et al.

[11] Patent Number: 4,634,543

[45] Date of Patent: Jan. 6, 1987

[54] SHOCK ABSORBER FLUID COMPOSITION AND SHOCK ABSORBER CONTAINING SAID COMPOSITION

[75] Inventors: Tahei Okada, Ichihara; Masahiko Takesue, Sodegaura, both of Japan

[73] Assignee: Idemitsu Kosan Company Limited, Tokyo, Japan

[21] Appl. No.: 720,694

[22] Filed: Apr. 8, 1985

Related U.S. Application Data

[63] Continuation-in-part of Ser. No. 415,371, Sep. 7, 1982, abandoned.

[30] Foreign Application Priority Data

Sep. 10, 1981 [JP] Japan ..... 56-142975

[51] Int. Cl.[4] ..... C10M 129/00; C10M 133/04; C10M 137/04; C10M 141/12

[52] U.S. Cl. ..... 252/78.5; 188/322.5; 252/32.5; 252/49.6; 252/49.8; 252/49.9; 252/78.1

[58] Field of Search ..... 188/322.5; 252/32.5, 252/49.6, 49.8, 49.9, 78.1, 78.5

[56] References Cited

U.S. PATENT DOCUMENTS

| | | | |
|---|---|---|---|
| 1,821,787 | 9/1931 | Black | 188/322.5 |
| 3,215,720 | 11/1965 | Atwood et al. | 252/49.8 |
| 3,496,104 | 2/1970 | Shimada et al. | 252/49.8 |
| 4,080,303 | 3/1978 | Friihauf et al. | 252/78.1 |
| 4,085,054 | 4/1978 | Bussi et al. | 252/49.9 |
| 4,176,076 | 11/1979 | Waldstein | 252/78.1 |
| 4,226,734 | 10/1980 | Schuster | 252/49.3 |

*Primary Examiner*—Paul Lieberman
*Assistant Examiner*—Robert A. Wax
*Attorney, Agent, or Firm*—Frishauf, Holtz, Goodman & Woodward

[57] ABSTRACT

A fluid composition for use in a shock absorber is described, comprising (a) a lubricating base oil, (b) 10 to 1,000 ppm, as calculated as boron, of a boron-containing compound, and (c) 100 to 3,000 ppm, as calculated as phosphorus, of phosphoric acid ester and/or phosphorous acid ester. The invention also provides a shock absorber containing said fluid composition as the shock absorber fluid. This shock absorber has the advantage of high abrasion resistance and a low coefficient of friction of movement of the movable parts relative to the stationary parts therein.

20 Claims, 2 Drawing Figures

SHOCK ABSORBER FLUID COMPOSITION AND SHOCK ABSORBER CONTAINING SAID COMPOSITION

This application is a continuation-in-part of application Ser. No. 415,371, filed Sept. 7, 1982 now abandoned.

BACKGROUND OF THE INVENTION

The present invention provides a fluid composition for use in a shock absorber, which has high abrasion resistance and a low coefficient of friction, and a shock absorber containing said fluid composition.

Hydraulic shock absorbers utilize a hydraulic fluid to absorb shock. Such shock absorbers include car shock absorbers which dampen the objectionable spring oscillations to provide a smooth ride of a car, hydraulic shock absorbers to lessen shocks in landing of aircraft, door checkers, etc.

The primary characteristics required for a shock absorber fluid, particularly a shock absorber fluid for a vehicular shock absorber follow:

(i) High abrasion resistance (durability);

(ii) Low coefficient of friction (comfortable running);

(iii) Does not attack and deteriorate the shock absorber seal (prevention of liquid leakage).

High pressure agents and lubrication agents have been widely used to provide high abrasion resistance and a low coefficient of friction. When using such high pressure agents and lubricating agents in a shock absorber in which there are various types of friction, such friction between a rod and a guide, friction between a rod and a seal, and friction between a piston and a cylinder, satisfactory results are not obtained since many of such agents exert adverse effects on the seal and they cannot be used satisfactorily over a wide temperature range.

THE INVENTION

The present invention provides shock absorbers containing an improved shock absorber fluid, comprising:

(a) a lubricating base oil;

(b) 10 to 1,000 ppm (by weight), calculated as boron, of a boron-containing compound; and (c) 100 to 3,000 ppm (by weight), calculated as phosphorus, of a phosphoric acid ester and/or a phosphorous acid ester.

The invention also provides an improved shock absorber which is characterized by using said shock absorber fluid composition as the shock absorber fluid. The shock absorber comprises a cylinder having a shock absorber fluid receiving space therein, a piston slidably mounted in said fluid receiving space of said cylinder for movement in the axial direction of the cylinder, a piston rod connected to said piston for moving said piston relative to said cylinder, and said shock absorbing fluid in said fluid receiving space in contact with said piston.

DETAILED DESCRIPTION OF THE INVENTION

Figure 1:
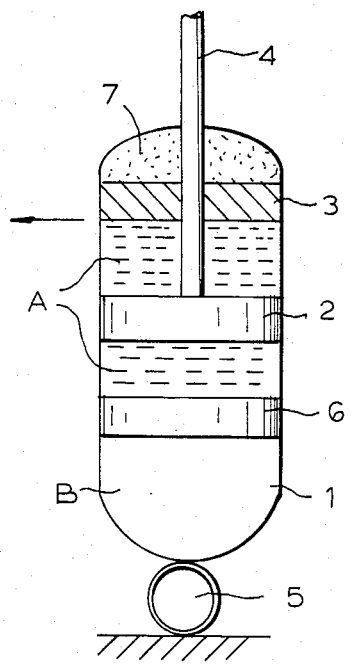

The lubricating base oils which can be used include the petroleum and synthetic lubricating oils which have been conventionally used as lubricating oils. Preferred lubricating base oils are those oils having a viscosity (at 40° C.) of from 5 to 50 centistokes (cst) and an aniline point of from 60 to 100.

The boron-containing compounds useful in the shock absorber fluids of the present invention include the boron-containing dispersants hitherto disclosed as dispersants to be added to lubricating oil for internal combustion engines, e.g., an engine oil for a car, to cause dispersion of insoluble contaminants entrained in the lubricating oil and to prevent the formation of sludge in the internal combustion engine and, furthermore, produces the effect, for example, of inhibiting the corrosion of metallic parts coming into contact with the lubricating oil. The prior art does not disclose that such boron-containing dispersants would have any utility as a component of shock absorber fluids.

Such known boron-containing dispersants include compounds prepared by reacting an alkyleneamine with a boron compound, and then reacting the reaction product with an alkyl-substituted succinic anhydride (see Japanese Patent Publication No. 8013/1967); compounds prepared by reacting a hydroxylated primary amine and a boron compound with an alkenylsuccinic anhydride (see Japanese Patent Application Laid-Open No. 52381/1976 and Canadian Patent 1,058,190), compounds which are prepared by reacting an aromatic polyvalent carboxylic acid, an alkenylsuccinic acid, and a polyalkylenepolyamine in a specific ratio, and then reacting the resulting reaction product with a boron compound (see Japanese Patent Application Laid-Open No. 130408/1976), condensates of an aminoalcohol, boric acid, and an oxyethanecarboxylic acid (see Japanese Patent Application Laid-Open No. 87705.1979, and U.S. Pat. Nos. 4,226,734 and 4,303,540), and compounds prepared by reacting a polyalkenylsuccinic anhydride successively with a polyalkylene glycol, a secondary alkanolamine and a boron compound.

Preferred boron-containing compounds include the compound prepared by reacting an aliphatic acid with an amine compound to form an amide compound and reacting the amide compound with a boron compound (e.g., boric acid, a boric acid salt, and a boric acid ester); and a reaction product of a hydrocarbon-substituted succinic acid imide and a boron compound, and their derivatives; such compounds being disclosed in more detail in the afore-identified Japanese Patent Publication Nos. 8013/1967 (which corresponds to U.S. Ser. No. 306,309/1963) and 8014/1967 (which corresponds to U.S. Ser. No. 306,291/1963), Japanese Patent Application Laid-Open No. 52381/1976, Canadian Patent 1,058,190, Japanese Patent Application Laid-Open Nos. 130408/1976 and 87705/1979, U.S. Pat. Nos. 4,226,734 and 4,303,540, Japanese Patent Application Laid-Open No. 157688/1980 and U.S. Pat. No. 2,568,472.

As described above, boron-containing compounds used in the present invention can be prepared by various methods. For example, the boron-containing agents can be prepared by reacting a hydrocarbon-substituted succinic acid or a fatty acid with an amine compound to form an amide compound, and reacting the amide compound with a boron compound.

The hydrocarbon-substituted succinic acid used herein is succinic acid substituted by a hydrocarbon having molecular weight of from 600 to 5000. The preferred fatty acid used herein include fatty acids having from 12 to 30 carbon atoms.

Examples of the amine compound used herein include monoamines having an alkyl group of from 1 to 40 carbon atoms, diamines having an alkylene group of from 1 to 40 carbon atoms, alkylalkylenediamines having from 9 to 26 carbon atoms, and polyalkylenepolyamines having from 2 to 6 alkyleneamine units of from 2 to 4 carbon atoms. As these monoamines, methylamine, dimethylamine, ethylamine, diethylamine, propylamine, laurylamine, myristylamine, stearylamine and distearylamine can be listed. These diamines include alkylenediamines such as ethylenediamine, trimethylenediamine, tetramethylenediamine, pentamethylenediamine and hexamethylenediamine, and alkylalkylenediamines represented by the general formula:

$$R—NH(CH_2)_n—NH_2$$

wherein R is an alkyl group having from 8 to 20 carbon atoms, and n is an integer of from 1 to 6. As these alkylalkylenediamines, N-lauryl-trimethylenediamine, N-stearyl-trimethylenediamine and N-octyl-ethylenediamine can be listed.

These alkylalkylenediamines are on the market in the trade name of Duomine C, Duomine S or Duomine T (made by Lion Aquzo Co., Ltd.).

Furthermore, the diamines used herein can be derived from natural fatty acids such as beef tallow oil, coconut oil and soybean oil. As these polyalkylenepolyamines, diethylenetriamine, triethylenetetramine, tetraethylenepentamine, hexaethyleneheptamine, heptaethyleneoctamine, tetrapropylenepentamine and hexabutyleneheptamine can be listed.

The shock absorber fluid compositions contain the boron-containing compound in an amount between about 10 and 1,000 ppm by weight calculated as boron, based on the lubricating base oil component of the said composition.

The component consisting of a phosphoric acid ester and/or phosphorous acid ester of the said composition is added to provide high abrasion resistance and a low coefficient of friction. Preferred examples of phosphoric acid esters are those represented by the following formulae:

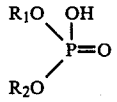

I wherein $R_1$ and $R_2$ may be the same or different and contain from 4 to 20 carbon atoms, and are each a saturated or unsaturated alkyl group, an aryl group, or an alkylsubstituted aryl group;

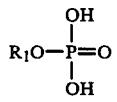

II

And preferred examples of phosphorous acid esters are those represented by the following formula:

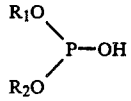

III wherein $R_1$ and $R_2$ are the same as described in the formula I.

In addition, reaction products of phosphoric acid esters and/or phosphorous acid esters and amine compounds can be used. Examples of phosphoric acid esters represented by the formulae I and II include butyl acid phosphate, 2-ethylhexyl acid phosphate, lauryl acid phosphate, and oleic acid phosphate. Examples of the phosphorous acid esters represented by formula III include dibutyl hydrogenphosphite, dilauryl hydrogenphosphite, distearyl hydrogenphosphite, dioleyl hydrogenphosphite, and diphenyl hydrogenphosphite. The phosphoric acid ester and/or phosphorous acid ester is added in an amount within the range of between 100 and 3000 ppm (by weight), as calculated as phosphorous, based on the lubricating base oil.

Commonly used lubrication additives can be added to the composition of the invention as long as they do not adversely effect the characteristics of the shock absorber composition of this invention. In particular it is preferred to add a lubricating agent to the composition of the invention. Examples of such lubricating agents include oil and fat, fatty acids, monoesters of fatty acids and alcohols, esters of fatty acids and polyhydric alcohols, e.g., sorbitan and glycerin, and esters of polyvalent carboxylic acids and alcohols. The amount of the lubricating agent is usually between about 0.05 and 20% by weight and preferably between about 0.5 and 10% based on the fluid composition. In addition, conventionally used anti-abrasion agents, e.g., metal dialkyldithiophosphates, metal dialkyldithiocarbamates, phosphosulfurized terpene, trialkyl phosphate, triaryl phosphate, trialkyl phosphite, and triaryl phosphite may be added. If desired, a viscosity index agent, an antioxidant, etc., can be added.

The invention is illustrated by the following examples:

EXAMPLES 1 TO 8 AND COMPARATIVE EXAMPLES 1 TO 3

Various fluid compositions were evaluated using a car shock absorber.

Frictional force was measured by the use of a shock absorber (gas-charged type) of the structure shown in FIG. 1. Referring to FIG. 1, the shock absorber comprises a cylinder 1, a piston 2, a guide 3, a rod 4, an eyelet 5, a seal 7, and a free piston 6. A space A in the cylinder 1 is charged with a shock absorber fluid, and a space B with nitrogen gas. A valve is equipped in the shock absorber (not shown in FIG. 1). When the pressure inside the shock absorber is increased, the valve is opened to take the fluid out of the shock absorber. Therefore, the pressure inside the shock absorber is not remarkably increased. In measuring the frictional force, the rod 4 was moved up and down at a high velocity, and the force required for this movement was designated as "frictional force". The conditions under which the shock absorber was operated follow:

| | |
|---|---|
| Stroke | ±5 millimeters (mm) |
| Rate of stroke | 0.01 hertz (Hz) |
| Horizontal load | 0 to 20 kilograms |
| Charged gas pressure | 15 kilograms per square centimeter ($kg/cm^2$) |

The horizontal load is a load which is applied to the cylinder in the direction vertical to the stroke direction, as indicated by the arrow in FIG. 1.

Figure 2:
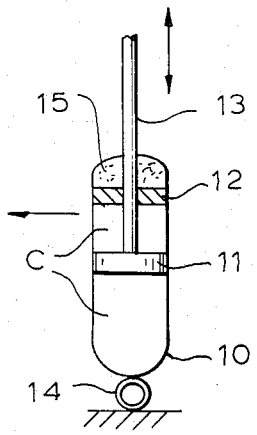

Abrasion resistance was measured using a shock absorber (strut type) of the structure shown in FIG. 2. Referring to FIG. 2, the shock absorber comprises a cylinder 10, a piston 11, a guide 12, a rod 13, and an eyelet 14. A space C in the cylinder 10 was charged with a shock absorber fluid composition. The fluid composition was used for lubrication between the cylinder and the piston, and between the rod and the seal 15, and guide. The shock absorber fluid flows from one side of the piston to the other under relative movement of the piston and cylinder, such flow being around the piston or through a valve in the piston, as is well known.

The conditions under which the shock absorber operation was operated follow:

| | |
|---|---|
| Stroke | ±25 millimeters (mm) |
| Rate of stroke | 3.0 hertz (Hz) |
| Horizontal load (in the arrow direction) | 20 kilograms |

The abrasion resistance (scratch durability) of the shock absorber fluid composition was determined by observing the appearance of the rod to examine the formation of cloud and scratch thereon. The results are shown in the Table 1.

The components of the shock absorber fluid compositions used in this example follow:

Lubricating Base Oil:

Petroleum lubricating oil (having a viscosity of 15 centistokes (cst) at 40° C.)

Boron-Containing Compound

A: The compound prepared by reacting the reaction product of isostearic acid and tetraethylenepentamine with boric acid (boron content: 0.7% by weight)

B: The product prepared by reacting the imide of polyisobutenyl succinic acid (Molecular weight: 1000) and tetraethylene pentamine with boric acid (boron content: 1.8% by weight)

C: The compound prepared by reacting the reaction product of trimethylenediamine and polybutenyl succinic acid (Molecular weight: 1200) with boric acid (boron content: 0.3% by weight)

Phosphorous Acid Ester:

Dilauryl hydrogenphosphite $((C_{12}H_{35}O)_2—P—OH)$ (phosphorus content: 7.2% by weight)

Phosphoric Acid Ester:

Oleyl phosphate (a mixture of $C_{18}H_{35}O—P(=O)(OH)—OH$ and $(C_{18}H_{35}O)_2P(=O)OH$)

(phosphorous content: 6.5% by weight)

Lubricating Agent: Stearic acid

Viscosity Index Agent: Polymethacrylate

Antioxidant: 2,6-Di-tert-butyl-p-cresol

The symbols used in the evaluation of the abrasion resistance (scratch durability of the rod) were as follows:

A: No change (clear)

B: Formation of clouds

C: Formation of scratches

The symbol (x) in the results of the measurement of frictional force indicates that the stick slip phenomenon occurred. This is the phenomenon wherein vibration or noise is caused between a cylinder and a piston, and between a rod and a guide.

TABLE 1

| | Example 1 | Example 2 | Example 3 | Example 4 | Example 5 | Example 6 | Example 7 | Example 8 | Comparative Examples 1 | Comparative Examples 2 | Comparative Examples 3 |
|---|---|---|---|---|---|---|---|---|---|---|---|
| Composition (% by weight) | | | | | | | | | | | |
| Lubricating Base Oil | 93.8 | 94.3 | 93.8 | 93.8 | 88.8 | 95.0 | 93.8 | 91.8 | 94.3 | 94.8 | 94.8 |
| Boron-Containing Compound A | 1.0 | 0.5 | — | 0.5 | | | | | — | — | 1.0 |
| Boron-Containing Compound B | — | — | 1.0 | 0.5 | 5.0 | 0.5 | | | — | — | — |
| Boron-Containing Compound C | — | — | — | — | | | 1.0 | 3.0 | — | — | — |
| Phosphorous Acid Ester | 1.0 | — | 1.0 | 0.5 | 2.0 | | 1.0 | 1.0 | 1.5 | — | — |
| Phosphoric Acid Ester | — | 1.0 | — | 0.5 | | 0.3 | | | — | 1.0 | — |
| Lubricating Agent | 1.0 | 1.0 | 1.0 | 1.0 | 1.0 | 1.0 | 1.0 | 1.0 | 1.0 | 1.0 | 1.0 |
| Viscosity Index-Agent | 3.0 | 3.0 | 3.0 | 3.0 | 3.0 | 3.0 | 3.0 | 3.0 | 3.0 | 3.0 | 3.0 |
| Antioxidant | 0.2 | 0.2 | 0.2 | 0.2 | 0.2 | 0.2 | 0.2 | 0.2 | 0.2 | 0.2 | 0.2 |
| Evaluation | | | | | | | | | | | |
| Frictional Force | | | | | | | | | | | |
| Horizontal Load (kg/cm²) 0 | 5 | 5 | 5 | 5 | 5 | 5 | 5 | 5 | 5 | 5 | 5 |
| 10 | 9 | 10 | 9 | 10 | 9 | 10 | 10 | 10 | 10 | 10 | 10 (x) |
| 20 | 16 | 17 | 17 | 15 | 17 | 20 | 20 | 19 | 15 | 17 | 31 (x) |
| Abrasion Resistance | | | | | | | | | | | |
| After 250,000 strokes | A | A | A | A | A | A | A | A | A | A | A |
| After 500,000 strokes | A | A | A | A | A | A | A | A | B | B | A |
| After 1,000,000 strokes | A | A | A | A | A | A | A | A | C | C | B |
| After 2,000,000 strokes | A | B | A | A | A | B | B | B | C | C | B |
| Friction Coefficient (Pendulum Testing Method (Soda Method)) | 0.12 | 0.12 | 0.12 | 0.12 | 0.12 | 0.14 | 0.12 | 0.12 | 0.12 | 0.12 | 0.12 |
| Boron Content (ppm) | 70 | 35 | 180 | 125 | 900 | 90 | 30 | 90 | — | — | 70 |
| Phosphorus Content (ppm) | 720 | 650 | 720 | 685 | 1440 | 195 | 720 | 720 | 1080 | 650 | — |

Although it may be considered that there is no significant difference in performance between the Examples of the invention and the Comparative Examples when tested by the conventional pendulum testing method, the testing under the conditions corresponding to use in service indicate that there is a great difference in performance between the Examples of the invention and the Comparative Examples, and that the Examples of the invention are superior to the Comparative Examples. Particularly, in the case of Comparative Example 3, which contain neither the phosphoric acid ester nor phosphorous acid ester, it can be seen that as the horizontal load is increased, the frictional force is increased and the formation of stick slip occurs.

EXAMPLE 9 AND COMPARATIVE EXAMPLE 4

A test in swelling grade of rubber was carried out according to JIS K 6301 by soaking rubber into fluid, wherein two kinds of fluids having composition shown in the Table 2 and Nitril Butadiene Rubber are used respectively. The initial physical properties of Nitril Butadiene Rubber is shown below.

| | |
|---|---|
| Hardness (JIS) | 80 |
| Tensile Stress (kgf/cm$^2$) | 80 |
| Tensile Strength (kgf/cm$^2$) | 234 |
| Elongation (%) | 330 |
| Tear Strength (kgf/cm$^2$) | 57 |

The test was carried out under conditions at a temperature of 150 centrigrade for 70 hours. The results are shown in the Table 2.

TABLE 2

| | Comparative Example 4 | Example 9 |
|---|---|---|
| Composition (by weight) | | |
| Lubricating Base Oil*1 | 99 | 98 |
| Boron-Containing Compound A*2 | 0 | 1 |
| Phosphoric Acid Ester*3 | 1 | 1 |
| Measured Value | | |
| Hardness | 83 | 81 |
| Change of Hardness | +3 | +1 |
| Tensile Strength (kgf/cm$^2$) | 152 | 224 |
| Ratio of Change | −35 | −4 |
| Elongation (%) | 158 | 280 |
| Ratio of Change | −52 | −15 |

Note;
*1Petroleum lubricating oil (having a viscosity of 15 centistokes (cst) at 40° C.)
*2The compound prepared by reacting the reaction product of isostearic acid and tetraethylenepentamine with boric acid (boron content: 0.7% by weight).
*3Oleylacid phosphate

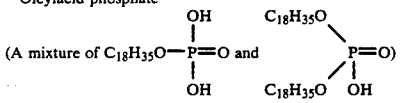

(phosphorous content: 6.5% by weight)

The test result shows that phosphoric acid ester has a remarkable influence upon rubber, and lowers tensile strength as well as elongation. However boron-containing compound shows an effect to reduce this influence of phosphoric acid ester upon rubber, so it is found that the inferior influence of phosphoric acid ester upon rubber is improved remarkably by using these two compounds in combination.

What is claimed is:

1. A fluid composition for use in a shock absorber, comprising:

(a) a lubricating base oil;

(b) 10 to 1,000 ppm, as calculated as boron, of at least one boron-containing compound selected from the group consisting of (i) a compound which is prepared by reacting an aliphatic acid and an amine compound to form an amide compound and then reacting the amide compound with a boron compound and (ii) a reaction product of a hydrocarbon-substituted succinic acid imide and a boron compound; and (c) 100 to 3,000 ppm, as calculated as phosphorus, of a phosphoric acid ester, a phosphorus acid ester, a mixture thereof, a reaction product of the phosphoric acid ester and amine compound, a reaction product of the phosphorus acid ester and amine compound or a reaction product of the mixture and amine compound, said phosphoric acid ester being selected from the group consisting of butyl acid phosphate, 2-ethylhexyl acid phosphate, lauryl acid phosphate and oleic acid phosphate, and said phosphorus acid ester being selected from the group consisting of dibutyl hydrogenphosphite, dilauryl hydrogenphosphite, distearyl hydrogenphosphite, dioleyl hydrogenphosphite and diphenyl hydrogenphosphite.

2. The fluid composition of claim 1 wherein said amine compound is selected from the group consisting of methylamine, diemethylamine, ethylamine, diethylamine, propylamine, laurylamine, myristylamine, stearylamine, distearylamine, ethylenediamine, trimethylenediamine, tetramethylenediamine, pentamethylenediamine, hexamethylenediamine, N-lauryl-trimethylenediamine, N-stearyl-trimethylenediamine, N-octyl-ethylenediamine, beef tallow oil diamine, coconut oil diamine, soybean oil diamine, diethylenetriamine, triethylenetetramine, tetraethylenepentamine, hexaethyleneheptamine, heptaethyleneoctamine, tetrapropylenepentamine and hexabutyleneheptamine.

3. The fluid composition of claim 2, wherein said boron-containing compound is a compound which is prepared by reacting an aliphatic acid and an amine compound to form an amide compound and then reacting the amide compound with a boron compound.

4. The fluid composition of claim 2, wherein said boron-containing compound is a reaction product of a hydrocarbon-substituted succinic acid imide and a boron compound.

5. The fluid composition of claim 4, wherein said hydrocarbon-substituted succinic acid has a molecular weight of from 600 to 5000.

6. The fluid composition of claim 2, wherein said phosphoric acid ester is selected from the group of lauryl acid phosphate and oleic acid phosphate and said phosphorus acid ester is selected from the group consisting of dilauryl hydrogenphosphite, distearyl hydrogenphosphite, dioleyl hydrogenphosphite and diphenyl hydrogenphosphite.

7. The fluid composition of claim 6, wherein said phosphorus compound is selected from the group consisting of lauryl acid phosphate and oleic acid phosphate.

8. The fluid composition of claim 6, wherein said phosphorus compound is selected from the group consisting of dilauryl hydrogenphosphite, distearyl hydrogenphosphite, dioleyl hydrogenphosphite and diphenyl hydrogenphosphite.

9. The fluid composition of claim 6, wherein said lubricating base oil is an oil having a viscosity at 40° C. of from 5 to 50 centistokes and an aniline point of from 60 to 100.

10. The fluid composition of claim 1, wherein said lubricating base oil having a viscosity at 40° C. of from 5 to 50 centistokes and an aniline point of from 60 to 100.

11. An improved shock absorber comprising a cylinder having a shock absorber fluid receiving space therein, a piston slidably mounted in said fluid receiving space of said cylinder for movement in the axial direction of the cylinder, a piston rod connected to said piston for moving said piston relative to said cylinder, and a shock absorbing fluid in said fluid receiving space in contact with said piston, the improvement comprising said shock absorbing fluid being the fluid composition of claim 3.

12. An improved shock absorber comprising a cylinder having a shock absorber fluid receiving space therein, a piston slidably mounted in said fluid receiving space of said cylinder for movement in the axial direction of the cylinder, a piston rod connected to said piston for moving said piston relative to said cylinder, and a shock absorbing fluid in said fluid receiving space in contact with said piston, the improvement comprising said shock absorbing fluid being the fluid composition of claim 4.

13. An improved shock absorber comprising a cylinder having a shock absorber fluid receiving space therein, a piston slidably mounted in said fluid receiving space of said cylinder for movement in the axial direction of the cylinder, a piston rod connected to said piston for moving said piston relative to said cylinder, and a shock absorbing fluid in said fluid receiving space in contact with said piston, the improvement comprising said shock absorbing fluid being the fluid composition of claim 1.

14. An improved shock absorber comprising a cylinder having a shock absorber fluid receiving space therein, a piston slidably mounted in said fluid receiving space of said cylinder for movement in the axial direction of the cylinder, a piston rod connected to said piston for moving said piston relative to said cylinder, and a shock absorbing fluid in said fluid receiving space in contact with said piston, the improvement comprising said shock absorbing fluid being the fluid composition of claim 2.

15. An improved shock absorber comprising a cylinder having a shock absorber fluid receiving space therein, a piston slidably mounted in said fluid receiving space of said cylinder for movement in the axial direction of the cylinder, a piston rod connected to said piston for moving said piston relative to said cylinder, and a shock absorbing fluid in said fluid receiving space in contact with said piston, the improvement comprising said shock absorbing fluid being the fluid composition of claim 5.

16. An improved shock absorber comprising a cylinder having a shock absorber fluid receiving space therein, a piston slidably mounted in said fluid receiving space of said cylinder for movement in the axial direction of the cylinder, a piston rod connected to said piston for moving said piston relative to said cylinder, and a shock absorbing fluid in said fluid receiving space in contact with said piston, the improvement comprising said shock absorbing fluid being the fluid composition of claim 6.

17. An improved shock absorber comprising a cylinder having a shock absorber fluid receiving space therein, a piston slidably mounted in said fluid receiving space of said cylinder for movement in the axial direction of the cylinder, a piston rod connected to said piston for moving said piston relative to said cylinder, and a shock absorbing fluid in said fluid receiving space in contact with said piston, the improvement comprising said shock absorbing fluid being the fluid composition of claim 7.

18. An improved shock absorber comprising a cylinder having a shock absorber fluid receiving space therein, a piston slidably mounted in said fluid receiving space of said cylinder for movement in the axial direction of the cylinder, a piston rod connected to said piston for moving said piston relative to said cylinder, and a shock absorbing fluid in said fluid receiving space in contact with said piston, the improvement comprising said shock absorbing fluid being the fluid composition of claim 8.

19. An improved shock absorber comprising a cylinder having a shock absorber fluid receiving space therein, a piston slidably mounted in said fluid receiving space of said cylinder for movement in the axial direction of the cylinder, a piston rod connected to said piston for moving said piston relative to said cylinder, and a shock absorbing fluid in said fluid receiving space in contact with said piston, the improvement comprising said shock absorbing fluid being the fluid composition of claim 9.

20. An improved shock absorber comprising a cylinder having a shock absorber fluid receiving space therein, a piston slidably mounted in said fluid receiving space of said cylinder for movement in the axial direction of the cylinder, a piston rod connected to said piston for moving said piston relative to said cylinder, and a shock absorbing fluid in said fluid receiving space in contact with said piston, the improvement comprising said shock absorbing fluid being the fluid composition of claim 10.

* * * * *